US005829239A

United States Patent [19]

Iwama et al.

[11] Patent Number: 5,829,239

[45] Date of Patent: Nov. 3, 1998

[54] SPINNING RING STRUCTURE

[75] Inventors: Yasushi Iwama, Iwakura; Yutaka Tanaka, Gifu; Hiroshi Enomoto; Hideyuki Goto, both of Ama-gun, all of Japan

[73] Assignees: Nippo Ltd., Osaka-fu; Howa Machinery, Ltd., Aichi-ken, both of Japan

[21] Appl. No.: 855,907

[22] Filed: May 14, 1997

[30] Foreign Application Priority Data

May 16, 1996 [JP] Japan ..... 8-121678

[51] Int. Cl.[6] ..... D01H 7/64

[52] U.S. Cl. ..... 57/124; 57/75; 57/119; 57/137

[58] Field of Search ..... 57/75, 119, 121, 57/124, 137

[56] References Cited

U.S. PATENT DOCUMENTS

| | | | |
|---|---|---|---|
| 4,150,531 | 4/1979 | Marzoli | 57/124 |
| 4,161,863 | 7/1979 | Marzoli | 57/124 |
| 4,244,170 | 1/1981 | Traynard et al. | 57/124 |
| 4,932,200 | 6/1990 | Etuya et al. | 57/124 |
| 5,331,797 | 7/1994 | Wurmli et al. | 57/119 |

FOREIGN PATENT DOCUMENTS

| | | | |
|---|---|---|---|
| 592885 | 2/1978 | U.S.S.R. | 57/119 |
| 80/00982 | 5/1980 | WIPO | 57/119 |

*Primary Examiner*—William Stryjewski
*Attorney, Agent, or Firm*—Ladas & Parry

[57] ABSTRACT

A spinning ring structure for use on a spinning frame comprises a stationary ring fixedly held in place, a rotary ring fitted in the stationary ring coaxially with the stationary ring so as to rotate about its center axis and provided with an annular flange at its upper end, a traveler put on the flange of the rotary ring for traveling along the flange to guide a yarn to a bobbin disposed coaxially with the rotary ring. Openings are formed through a neck portion of the rotary ring, whereby flies produced during the spinning operation by friction between the yarn and the traveler are discharged outside the spinning ring structure through the openings due to centrifugal force.

6 Claims, 5 Drawing Sheets

SPINNING RING STRUCTURE

BACKGROUND OF THE INVENTION

1. Field of the Invention

The present invention relates to a spinning ring structure for winding a yarn delivered from a yarn delivery unit on a bobbin.

2. Description of the Related Art

JP-A 9-31767 published Feb. 4, 1997 discloses a spinning ring structure 210 as shown in FIG. 6. This spinning ring structure 210 has a stationary ring 220, a rotary ring 230 disposed inside and supported for rotation on the stationary ring 220 and having a flange 232 at its upper end, and a traveler 250 put on the flange 232 of the rotary ring 230 for sliding along the flange 232. The rotary ring 230 rotates and the traveler 250 slides along the flange 232, whereby a fleece delivered from a yarn delivery unit is twisted into a yarn T, and the yarn T is wound on a bobbin 282 disposed coaxially with the rotary ring 230 as the bobbin 282 rotates.

In most cases, flies (short waste fibers) D are produced while the yarn T is twisted and wound on the bobbin 282. The flies D adhere to the inner circumference 234*a* of a neck portion 234 under the flange 232, the flies D are compacted and caused to adhere firmly to the inner circumference 234*a* of the neck 234 by a centrifugal force F as the rotary ring 230 rotates, and the thickness of the compact layer of the flies D increases gradually. Eventually, the sliding motion of the traveler 250 along the flange 232 and the rotation of the rotary ring 230 is obstructed by the compact layer of accumulated flies D and the spinning ring structure is unable to function properly for spinning.

SUMMARY OF THE INVENTION

Accordingly, it is an object of the present invention to provide a spinning ring structure capable of preventing the adhesion of short waste fibers thereto and of securing a satisfactory spinning operation.

According to the present invention, a spinning ring structure for winding a yarn delivered from a yarn delivery unit on a bobbin comprises a stationary ring fixedly held in place, a rotary ring fitted in the stationary ring coaxially with the stationary ring so as to rotate about its center axis and provided with an annular flange at its upper end, a traveler put on the flange of the rotary ring for traveling along the flange to wind a yarn delivered from the yarn delivery unit on the bobbin disposed coaxially with the rotary ring. In this spinning ring structure, openings are formed through a neck portion under the flange.

The traveler and the rotary ring are dragged for turning by the yarn as the bobbin rotates to twist the yarn delivered from the yarn delivery unit and to wind the yarn on the bobbin. Flies produced from the yarn in a space surrounded by the rotary ring are discharged outside rotary ring through the radial openings formed in the neck of the rotary ring. Even if flies adhere to the inner circumference of the rotary ring, flies are forced to move from the inside of the rotary ring through the openings to the outside of the rotary ring by centrifugal force which acts on flies turning together with the rotary ring and, therefore, flies are unable to accumulate on the inner circumference of the neck portion of the rotary ring. Consequently, the rotation of the rotary ring and the revolution of the traveler along the flange of the rotary ring are not obstructed by flies; that is, the smooth rotation of the rotary ring and the smooth revolution of the traveler are ensured for a satisfactory spinning operation.

According to the present invention, a portion of the inner circumference of the rotary ring extending downward from the flange may be tapered so as to expand toward its lower end. The tapered portion of the inner circumference may have a straight section in which the diameter remains unchanged.

In this case, if flies adhere to the inner circumference of the rotary ring during spinning operation in which the bobbin rotates, the rotary ring rotates and the traveler revolves along the flange of the rotary ring to twist the yarn delivered from the yarn delivery unit and wind the yarn on the bobbin, centrifugal force acts on the flies turning together with the rotary ring. Since the inner circumference of the rotary ring extending downward from the flange is tapered so as to expand toward the lower end, a component of the centrifugal force acting in a direction along the tapered inner circumference of the rotary ring forces the flies adhering to the tapered inner circumference of the rotary ring downward along the tapered inner circumference and, eventually, the flies are removed from the rotary ring at the lower end of the rotary ring. Consequently, the rotation of the rotary ring and the revolution of the traveler along the flange of the rotary ring are not obstructed by flies; that is, the smooth rotation of the rotary ring and the smooth revolution of the traveler are ensured for a satisfactory spinning operation.

The above and other objects, features and advantages of the present invention will become more apparent from the following description taken in connection with the accompanying drawings.

DETAILED DESCRIPTION OF THE PREFERRED EMBODIMENTS

A spinning frame to be equipped with spinning ring structures in accordance with the present invention will be described prior to the description of the preferred embodiments of the present invention.

Figure 1:
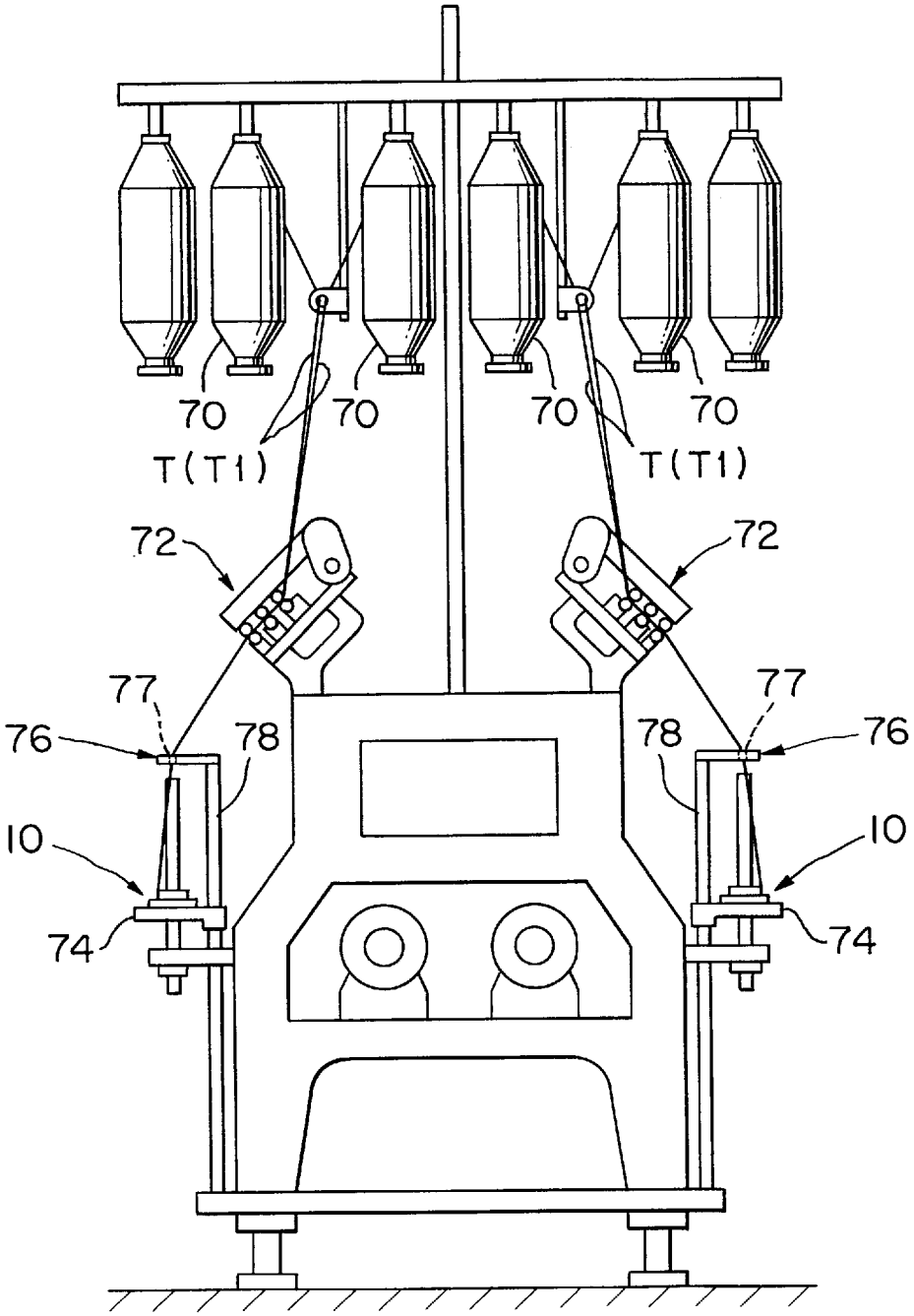
FIG. 1 is an end view of a spinning frame employing a spinning ring structure of the present invention.
Figure 2:
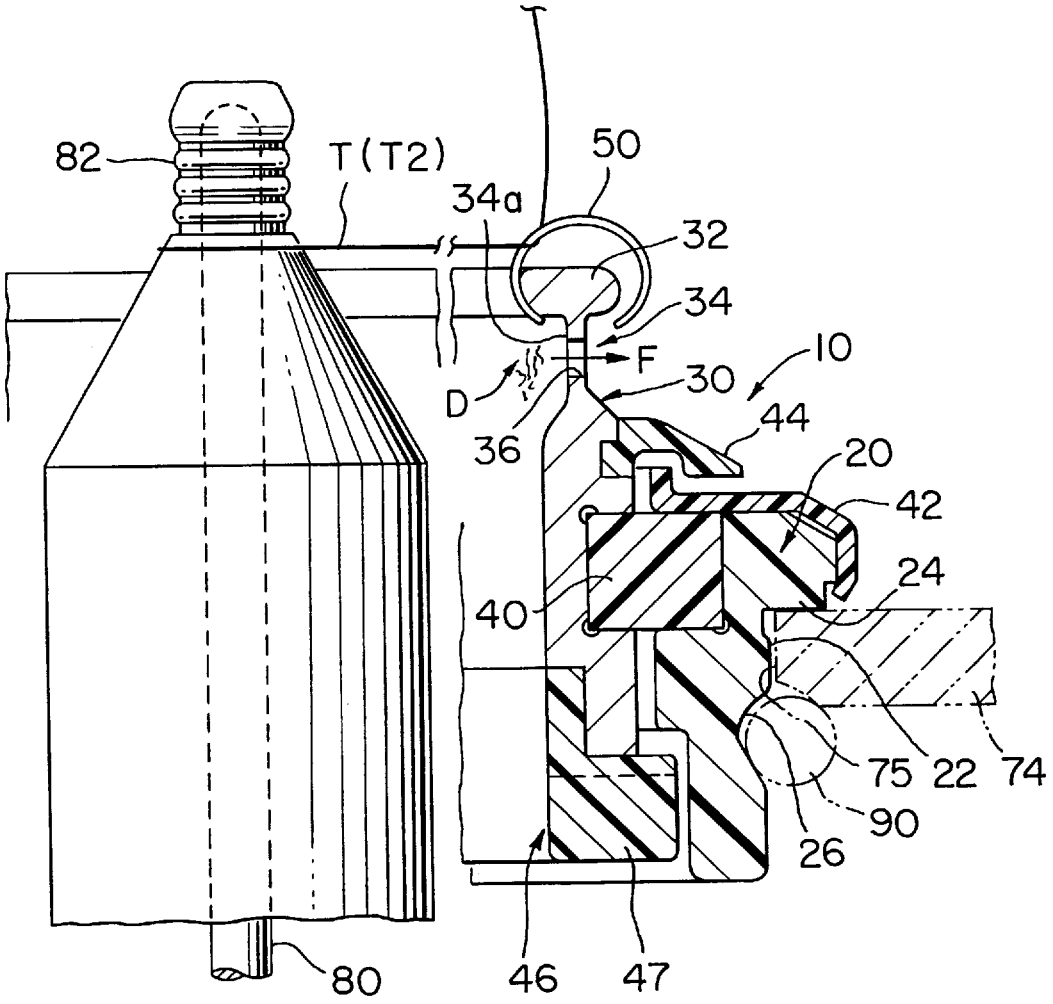
FIG. 2 is an enlarged fragmentary sectional view of a spinning ring structure in a first embodiment according to the present invention.

Referring to FIG. 1, a plurality of roving packages 70 are supported on package support bars extended perpendicularly to the sheet of FIG. 1 in an upper portion of a spinning frame. A plurality of drafting unit 72 are arranged in a row perpendicular to the sheet of FIG. 1 under the roving packages 70. A plurality of yarn guides 76 each having a guide hole 77 are arranged in a row perpendicular to the sheet. Ring rails 74 are extended perpendicularly to the sheet and are supported for vertical reciprocation along guide rods 78. As shown in FIG. 2, a plurality of mounting holes 75 are formed in each ring rail 74 and spinning ring structures 10 are fitted in the mounting holes 75, respectively.

A spindle 80 is supported for spinning so as to extend through and coaxially with the spinning ring structure 10. The spindle 80 is driven for spinning by a motor, not shown. A bobbin 82 (FIG. 2) is put on the spindle 80 and is restrained from turning relative to the spindle 80. A roving T1 unwound from the roving package 70 is drafted into a fleece by the drafting unit 72. The fleece is twisted into a yarn T2 as the same advances through the guide hole 77 of the yarn guide 76, and through a traveler 50 put on a rotary ring 30 included in the spinning ring structure 10, to the bobbin 82, and the yarn T2 is wound on the bobbin 82. The ring rail 74 reciprocates vertically while the bobbin 82 rotates together with the spindle 80 to wind the yarn T2 on the bobbin 82.

First Embodiment

A spinning ring structure 10 in a first embodiment according to the present invention will be described with reference to FIGS. 2 to 4.

Referring to FIG. 2, the spinning ring structure 10 comprises a stationary ring 20, the rotary ring 30 and the traveler 50. The stationary ring 20 made of a synthetic resin has an annular flange 24, and a fitting portion 22 having a cylindrical outer circumference provided with an annular groove 26 for receiving a rubber retaining ring 90. The fitting portion 22 of the stationary ring 20 is fitted in the mounting hole 75 of the ring rail 74 with the flange 24 seated on the surface of the ring rail 74, and then the rubber retaining ring 90 is fitted in the groove 26 to hold the stationary ring 20 in place on the ring rail 74. The rotary ring 30 is supported for rotation in the stationary ring 20 coaxially with the stationary ring 20. A sliding ring 40 made of an engineering plastic is interposed between the stationary ring 20 and the rotary ring 30 to enable the rotary ring 30 to rotate smoothly relative to the stationary ring 20. The sliding ring 40 made of an engineering plastic is retained in place by a retaining cover 42 fixedly put on the stationary ring 20. An annular dustproof cover 44 is attached to an upper portion of the rotary ring 30 to exclude dust from the gap between the stationary ring 20 and the rotary ring 30. The rotary ring 30 is provided at its upper end with an annular flange 32, and a neck portion 34 is formed continuously with the flange 32. The inner circumference 34*a* of the neck portion 34 is recessed radially outward with a smooth curve relative to the inner circumference of the flange 32 and the inner surface of a portion of the rotary ring 30 extending downward from the neck portion 34. The recessed portion is in the form of an annular recess.

Figure 3:
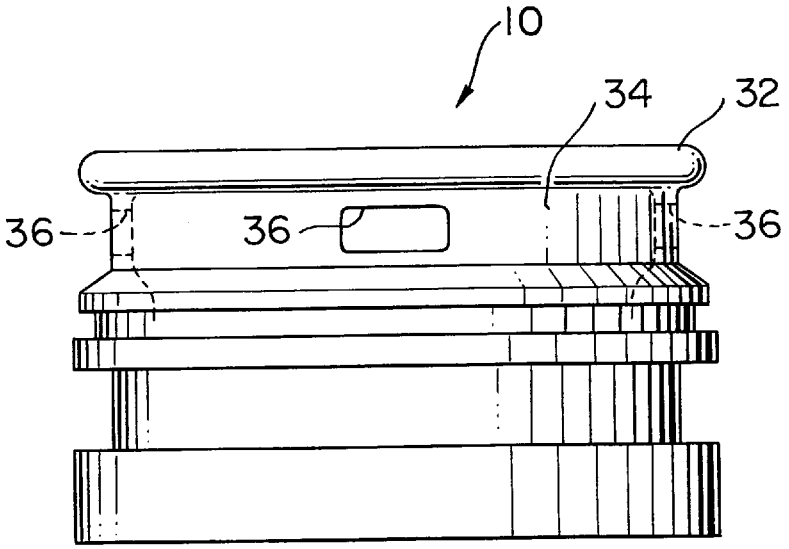
FIG. 3 is a front view of a rotary ring included in the spinning ring structure of FIG. 2.

As shown in FIG. 3, four openings 36 are formed in the neck portion 34 at equal angular intervals. A space enclosed by the rotary ring 30 is able to communicate with a space surrounding the rotary ring 30 by way of the openings 36. The number of the openings 36 need not be limited to four, but may be six, eight or any suitable number. The openings 36 need not necessarily be of a rectangular cross section as shown in FIG. 3, but may be of an elliptic cross section, a circular cross section or of any suitable cross section. It is to be noted that the radially outwardly recessed portion of the inner circumference 34*a* is located in the region of the openings 36.

Figure 4:
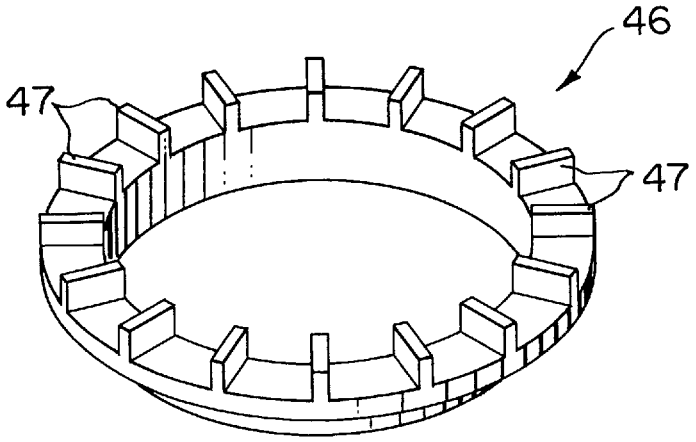
FIG. 4 is a perspective view of a brake ring included in the spinning ring structure of FIG. 2 in an inverted position.

A brake ring 46 as shown in an inverted attitude in FIG. 4 is fixedly fitted in a lower end portion of the rotary ring 30. The brake ring 46 is provided with a plurality of vanes 47 to apply a braking force, i.e., the resistance of air, according to the rotational speed of the rotary ring 30 to the rotary ring 30.

Referring again to FIG. 2, the traveler 50 is put on the flange 32 of the rotary ring 30 so as to travel along the circumference of the flange 32.

The stationary ring 20, the rotary ring 30, the traveler 50, the sliding ring 40 and the brake ring 46 of the spinning ring structure 10 are designed so that the rotational speed of the rotary ring 30 and the revolving speed of the traveler 50 are substantially equal to each other when the bobbin 82 is rotating in a steady state at a high rotational speed in a range of 10,000 to 15,000 rpm.

The bobbin 82 rotates together with the spindle 80, the roving T1 unwound from the roving package 70 is drafted by the drafting unit 72 into a fleece, the fleece is twisted into a yarn T2 as the same advances through the guide hole 77 of the yarn guide 76 by the agency of the traveler 50, and the yarn T2 is wound on the bobbin 82. The traveler 50 starts revolving when the bobbin starts rotating, and the rotary ring 30 is rotated relative to the stationary ring 20 by a frictional force exerted by the revolving traveler 50 on the rotary ring 30. After the bobbin 82 has started rotating in a steady state at a high rotational speed in the range of 10,000 to 15,000 rpm, the speed of the traveler 50 relative to the rotary ring 30 decreases substantially to zero and the rotary ring 30 rotates together with the traveler 50 relative to the stationary ring 20. Consequently, the traveler 50 is subject scarcely to the frictional resistance of the rotary ring 30, the traveler 50 is abraded scarcely and hence the life of the traveler 50 is extended.

Flies D produced during the spinning operation by friction between the yarn T2 and the traveler 50 and the like are discharged outside the spinning ring structure 10 through the openings 36 of the rotary ring 30. Even if some flies D adhere to the inner circumference of the rotary ring 30, centrifugal force F generated by the rotation of the rotary ring 30 acts on the flies D to discharge the flies D outside through the openings 36. Accordingly, flies D are unable to accumulate on the inner circumference of the rotary ring 30, so that the smooth rotation of the rotary ring and the smooth revolution of the traveler are secured for a satisfactory spinning operation. The radially outward recess in the inner circumference 34*a* assists the flies D to move into the openings 36.

Second Embodiment

A spinning ring structure 110 in a second embodiment according to the present invention will be described with reference to FIG. 5. The spinning ring structure 110 in the second embodiment is basically similar in construction to the spinning ring structure 10 in the first embodiment, and hence particulars of the spinning ring structure 110 different from those of the spinning ring structure 10 will mainly be described.

Figure 5:
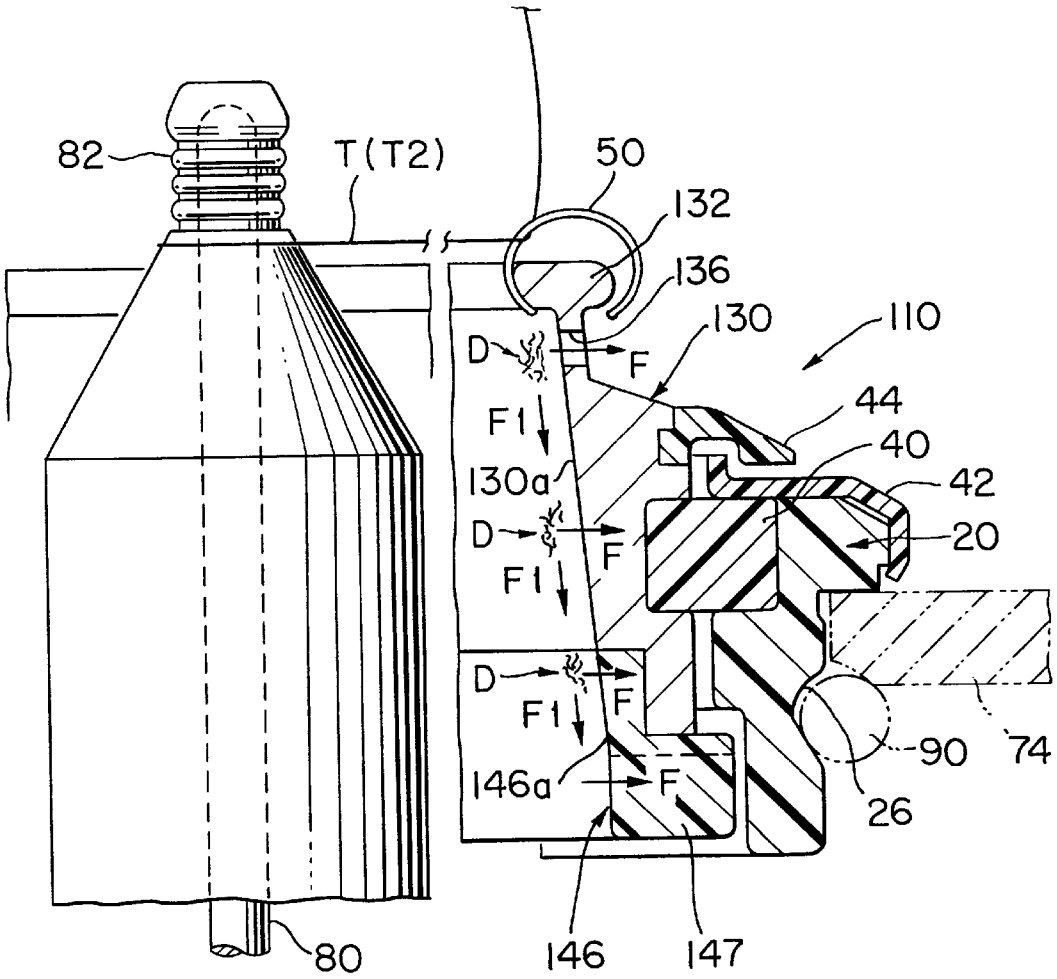
FIG. 5 is an enlarged fragmentary sectional view of a spinning ring structure in a second embodiment according to the present invention.
Figure 6:
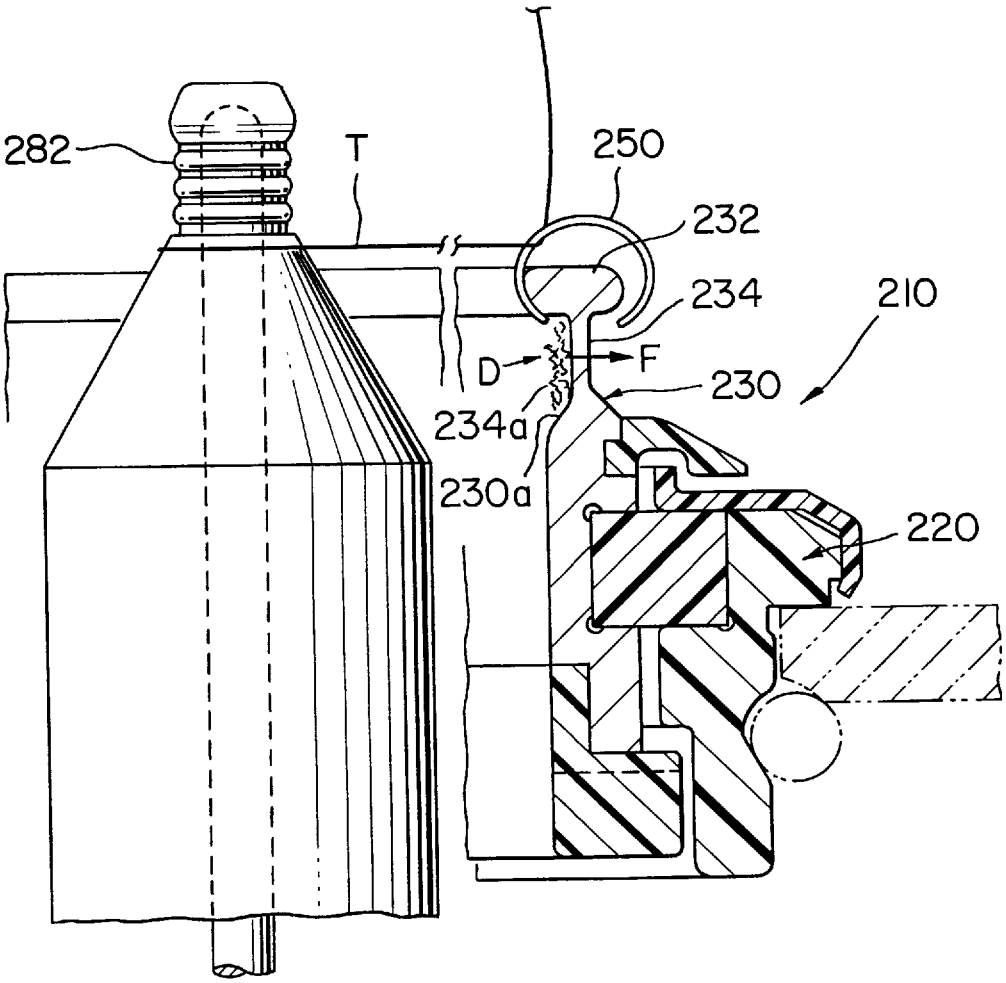
FIG. 6 is an enlarged fragmentary sectional view of a conventional spinning ring structure.

Referring to FIG. 5, the spinning ring structure 110 comprises a stationary ring 20, a rotary ring 130 having a flange 132 at its upper end, and a traveler 50. A brake ring 146 provided with a plurality of vanes 147 is fixedly fitted in a lower end portion of the rotary ring 130. A portion of the inner circumference of the rotary ring 130 extending downward from the flange 132 is tapered so as to expands toward its lower end. The inner circumference 146*a* of the brake ring 146 is also tapered so as to merge into the tapered portion 130*a* of the inner circumference of the rotary ring 130. Openings 136 similar to the opening 36 shown in FIG. 2 are provided at circumferential intervals immediately below an annular flange 132.

If flies D produced from the yarn T2 adhere to the tapered portion 130*a* of the inner circumference of the rotary ring

130, centrifugal force acts on the flies D adhering to the tapered portion 130*a* when the rotary ring 130 rotates. A component force F1 of the centrifugal force F, acting along the tapered portion 130*a* of the inner circumference of the rotary ring 130 forces the flies D adhering to the inner circumference of the rotary ring 130 to move downward along the tapered portion 130*a* of the inner circumference of the rotary ring 130 and the tapered inner circumference 146*a* of the brake ring 146 and, eventually, the flies D are separated from the rotary ring 130 at the lower end of the rotary ring 130. Flies D produced immediately below the flange 132 are discharged through the openings 136 radially outward as in the embodiment shown in FIG. 2.

Thus, the spinning ring structure 110 prevents the accumulation of flies D on the inner circumference of the rotary ring 130, so that the smooth rotation of the rotary ring and the smooth revolution of the traveler are secured for a satisfactory spinning operation.

Although the invention has been described in its preferred form with a certain degree of particularity, obviously many changes and variations are possible therein. It is therefore to be understood that the present invention may be practiced otherwise than as specifically described herein without departing from the scope and spirit thereof.

What is claimed is:

1. A spinning ring structure for twisting a fleece delivered from a yarn delivery unit into a yarn and winding the yarn on a bobbin for a spinning operation, the spinning ring structure comprising:

a stationary ring fixedly held in place;

a rotary ring fitted in the stationary ring coaxially with the stationary ring for rotation about a center axis thereof and provided with an annular flange at an upper end thereof, the annular flange providing a neck portion therebelow; and a traveler put on the flange of the rotary ring for traveling along the flange to guide the yarn to the bobbin, the bobbin being disposed coaxially with the rotary ring, the neck portion of the rotary ring having defined therein at least one opening to discharge therethrough by centrifugal force flies produced during the spinning operation.

2. The spinning ring structure according to claim 1, wherein a portion of the inner circumference of the rotary ring continuously extending downward from the flange is tapered so as to expand toward its lower end.

3. The spinning ring structure according to claim 1, wherein the neck portion of the rotary ring has an inner circumferential surface that is recessed radially outwardly of the rotary ring in a region of the opening.

4. The spinning ring structure according to claim 3, wherein the inner circumferential surface is annularly recessed.

5. The spinning ring structure according to claim 1, wherein there is more than one opening, the openings being at circumferentially spaced positions.

6. A spinning ring structure for twisting a fleece delivered from a yarn delivery unit into a yarn and winding the yarn on a bobbin for a spinning operation, said spinning ring structure comprising:

a stationary ring;

a rotary ring fitted in the stationary ring coaxially therewith for rotation about a center axis thereof and provided with an annular flange at an upper end thereof, the annular flange providing a neck portion therebelow;

a traveler put on the flange of the rotary ring for traveling along the flange to guide the yarn to the bobbin, the bobbin being disposed coaxially with the rotary ring; and opening means in the neck portion having to discharge therethrough flies produced during the spinning operation, the rotary ring having an inner circumferential surface extending downwardly from the flange and being tapered so as to expand toward a lower end thereof.

* * * * *